United States Patent [19]

Albertson

[11] 4,363,314

[45] Dec. 14, 1982

[54] HEATING APPARATUS

[76] Inventor: Robert V. Albertson, 2100 Shadywood Rd., Wayzata, Minn. 55391

[21] Appl. No.: 216,658

[22] Filed: Dec. 15, 1980

[51] Int. Cl.[3] ..... F24H 3/02

[52] U.S. Cl. ..... 126/110 B; 126/77; 126/110 E; 126/112; 126/116 A

[58] Field of Search ..... 126/112, 110 R, 110 B, 126/110 E, 116 A, 99 R, 99 D, 110 D, 245, 67, 77, 15 A

[56] References Cited

U.S. PATENT DOCUMENTS

| | | | |
|---|---|---|---|
| 1,811,616 | 6/1931 | Doyle | 126/112 |
| 2,268,778 | 1/1942 | Schueder et al. | 126/67 |
| 2,279,975 | 4/1942 | Evans | 126/110 |
| 2,519,241 | 8/1950 | Findley | 126/116 |
| 2,599,101 | 6/1952 | Frerer | 126/116 A |
| 2,780,218 | 2/1957 | Allen | 126/110 B |
| 2,804,066 | 8/1957 | McCutchen | 126/110 |
| 3,007,466 | 11/1961 | Mayo | 126/93 |
| 3,017,112 | 1/1962 | Amundson | 126/116 A |
| 3,029,803 | 4/1962 | Breese | 126/110 |
| 3,150,657 | 9/1964 | Shultz | 126/110 E |
| 3,765,398 | 10/1973 | Morris | 126/110 B |
| 4,002,157 | 1/1977 | Toesca | 126/110 B |
| 4,037,582 | 7/1977 | Moody | 126/110 R |
| 4,132,353 | 1/1979 | Briggs | 126/110 B |
| 4,140,101 | 2/1979 | Glover | 126/110 |
| 4,154,210 | 5/1979 | Jaymes | 126/245 |
| 4,203,415 | 5/1980 | Gruber | 126/110 R |
| 4,206,743 | 6/1980 | Niemela | 126/110 |

*Primary Examiner*—Daniel J. O'Connor

*Attorney, Agent, or Firm*—Burd, Bartz & Gutenkauf

[57] ABSTRACT

An apparatus for heating a fluid, as air, having a housing surrounding a heat transfer chamber. A casing having a combustion chamber is located in the heat transfer chamber. A motor driven fan mounted on the housing operates to supply air to the combustion chamber and move air through the heat transfer chamber. Fuel, as waste oil, is metered to the combustion chamber and burned. The air supplied to the combustion chamber moves the burning fuel in a circular pattern to promote combustion of the fuel adjacent the casing thereby heating the casing. The air moved through the heat transfer chamber picks up heat from the hot casing. The heated air is discharged through an open grill into the environment surrounding the apparatus.

41 Claims, 12 Drawing Figures

HEATING APPARATUS

SUMMARY OF INVENTION

The invention is an improvement in an apparatus for heating a fluid, such as air, gas, liquid, and the like, with waste petroleum fuel . A variety of fuels is useable as a combustion product by the apparatus. These fuels include drain oils, hydraulic fluids, aviation fluids, transmission fluids, and number 1 and number 2 fuel oils. The various fuels can be a mixture of fuels, which are burned in the apparatus in an efficient manner. The apparatus is adjustable to accommodate the different fuels so that the burning of a fuel produces a minimum of pollutants. The apparatus is an economical and efficient incinerator for waste oil to heat air in the work environment, such as service stations, implement stores, and agricultural buildings, as barns, farrowing houses, and the like. The apparatus is also useable to heat air to provide a source of hot air for drying crops, such as corn, sunflowers, and the like.

The apparatus has a housing with an air heating chamber. The housing has inlet and exit openings which allow air to flow through the heating chamber around an upright casing having a combustion chamber. An air moving device, such as a motor driven fan, mounted on the housing operates to move air through the heating chamber. The air flowing through the heating chamber picks up heat from the casing and is discharged through the exit opening as hot air into the environment surrounding the apparatus. A partition in the heating chamber separates the inlet opening from the exit opening and directs the air around the casing to facilitate the transfer of heat from the casing to the air in the heating chamber.

In one form of the invention, the air moving device functions to continuously introduce air into the combustion chamber to insure substantially complete combustion of the fuel and maximum heat energy from the fuel. The air from the air moving device is directed through a passage in a tubular member into the combustion chamber. The air flows in a circular direction around the inside of the casing. This locates the hot burning fuel and air in close proximity to the casing thereby heating the casing. The heat is transferred through the casing and picked up by the air in the heating chamber.

A fuel supply means carries the fuel across the heating chamber and discharges the fuel into the combustion chamber. The discharge end of the fuel supply means is located adjacent the discharge end of the air being introduced into the combustion chamber to facilitate the mixing of the air with the fuel in the combustion chamber. A fuel supply control operates to regulate the rate of flow of fuel into the combustion chamber. The control includes a temperature responsive unit operable to terminate the power supply to the air moving device when the temperature of the air in the fluid heating chamber exceeds a preselected upper limit or falls below a preselected lower limit. The temperature responsive unit also operates to terminate the flow of fuel to the combustion chamber when the temperature of the air in the heating chamber exceeds a preselected upper temperature or falls below a preselected lower temperature. The fuel supply control automatically operates to shut down the apparatus in an overheated condition, as well as a flame-out condition.

A removable fire pan is located in the bottom of the combustion chamber. The housing has a door which allows the fire pan to be removed from the casing to facilitate maintenance and cleaning of the combustion chamber.

IN THE DRAWINGS

DESCRIPTION OF PREFERRED EMBODIMENTS

Figure 1:
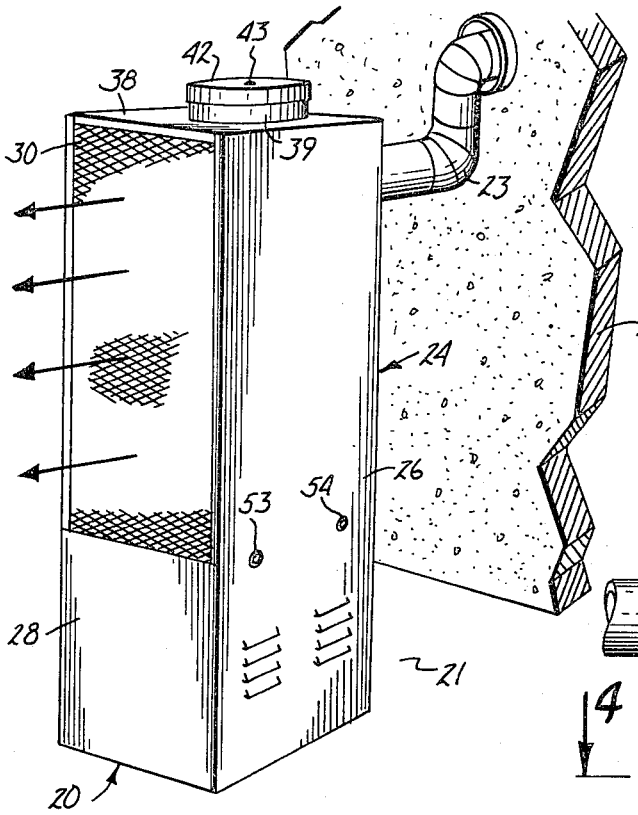
FIG. 1 is a perspective view of the heating apparatus of the invention.

Referring to FIG. 1, there is shown the heating apparatus of the invention indicated generally at 20 located in a space 21 adjacent an upright wall 22. Heating apparatus 20 is a forced air heater or incinerator which operates to heat air in an enclosed space, such as a garage, warehouse, or work area. Heating apparatus 20 is useable in a variety of environments to heat air, as well as other fluids, including gases and liquids. A crop dryer can be provided with hot air from the heating apparatus 20. The rear of heating apparatus 20 is connected to an exhaust gas pipe 23. Pipe 23 is a conventional stove pipe extended through wall 22 to the outside environment.

Figure 5:
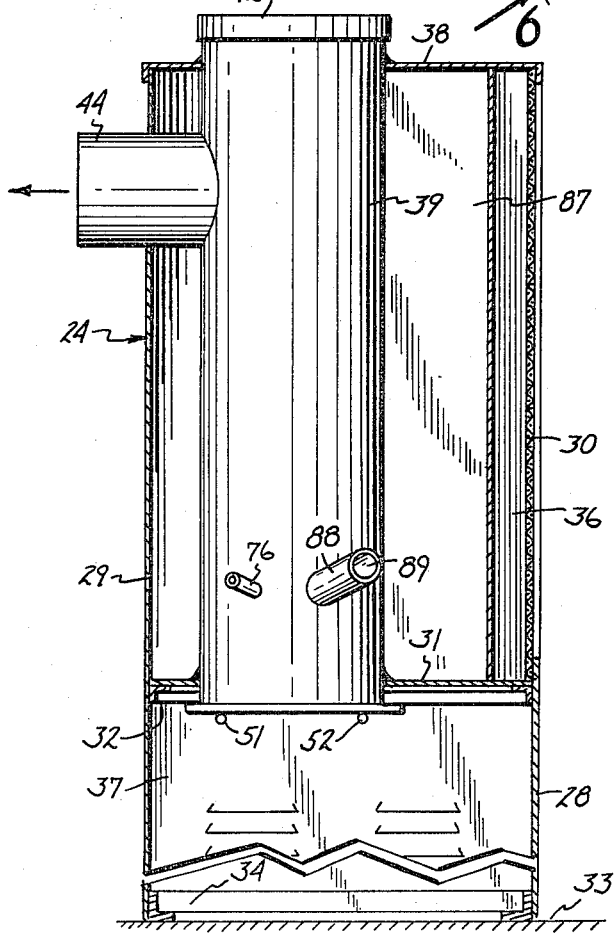
FIG. 5 is an enlarged sectional view taken along the line 5—5 of FIG. 3.

Heating apparatus 20 has a generally box-shaped housing indicated generally at 24 supported on a floor or bottom support 23. Housing 24 has generally rectangular upright side walls 26, 27, 28, and 29. Walls 26–29 are flat sheet metal that are secured together along their adjacent edges to provide the box-shaped housing 24. The housing for the heating apparatus can be cylindrical in shape surrounding a circular heating chamber. As shown in FIG. 5, a flat horizontal bottom wall 31 is located within the housing 24. Angle members 32 attach bottom wall 31 to the walls 26–29 above floor 33. Wall 31 divides the inside of housing 24 into an upper chamber 36 and a lower chamber 37. A base frame 34 secured to the lower ends of walls 26–29 supports housing 24 on floor 33. A top wall 38 attached to the upper edges of walls 26–29 closes the top of upper chamber 36. The upper chamber 36 is a heating chamber. The lower chamber 37 is a clean-out and servicing chamber.

Figure 4:
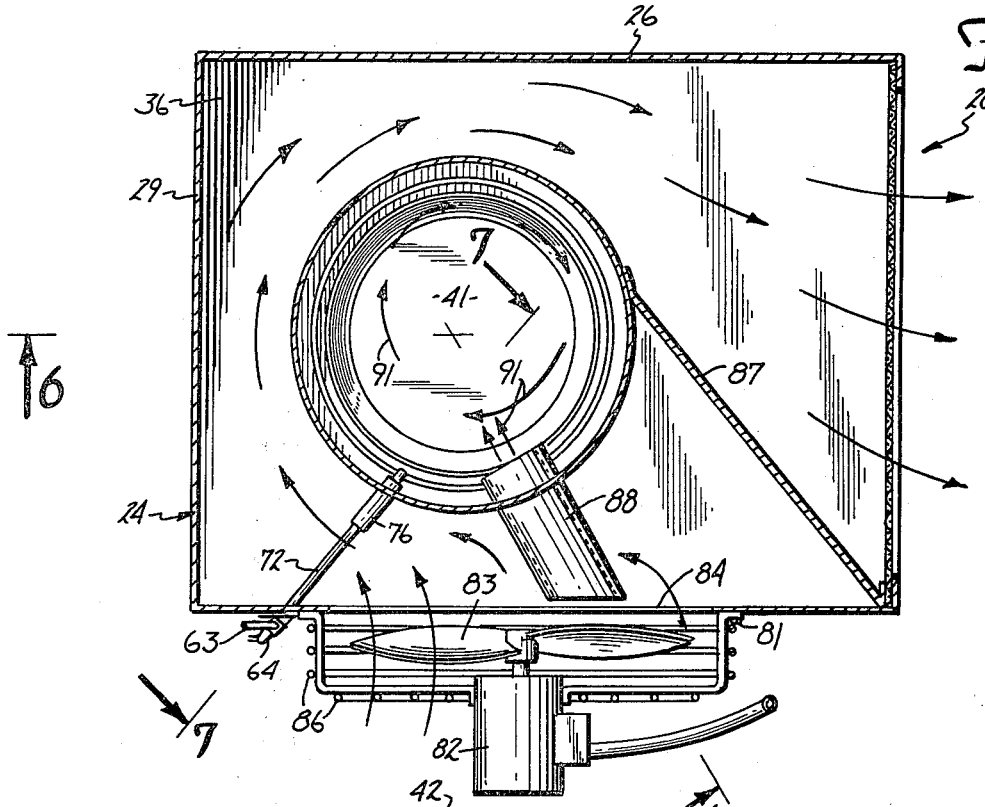
FIG. 4 is an enlarged sectional view taken along the line 4—4 of FIG. 2.
Figure 6:
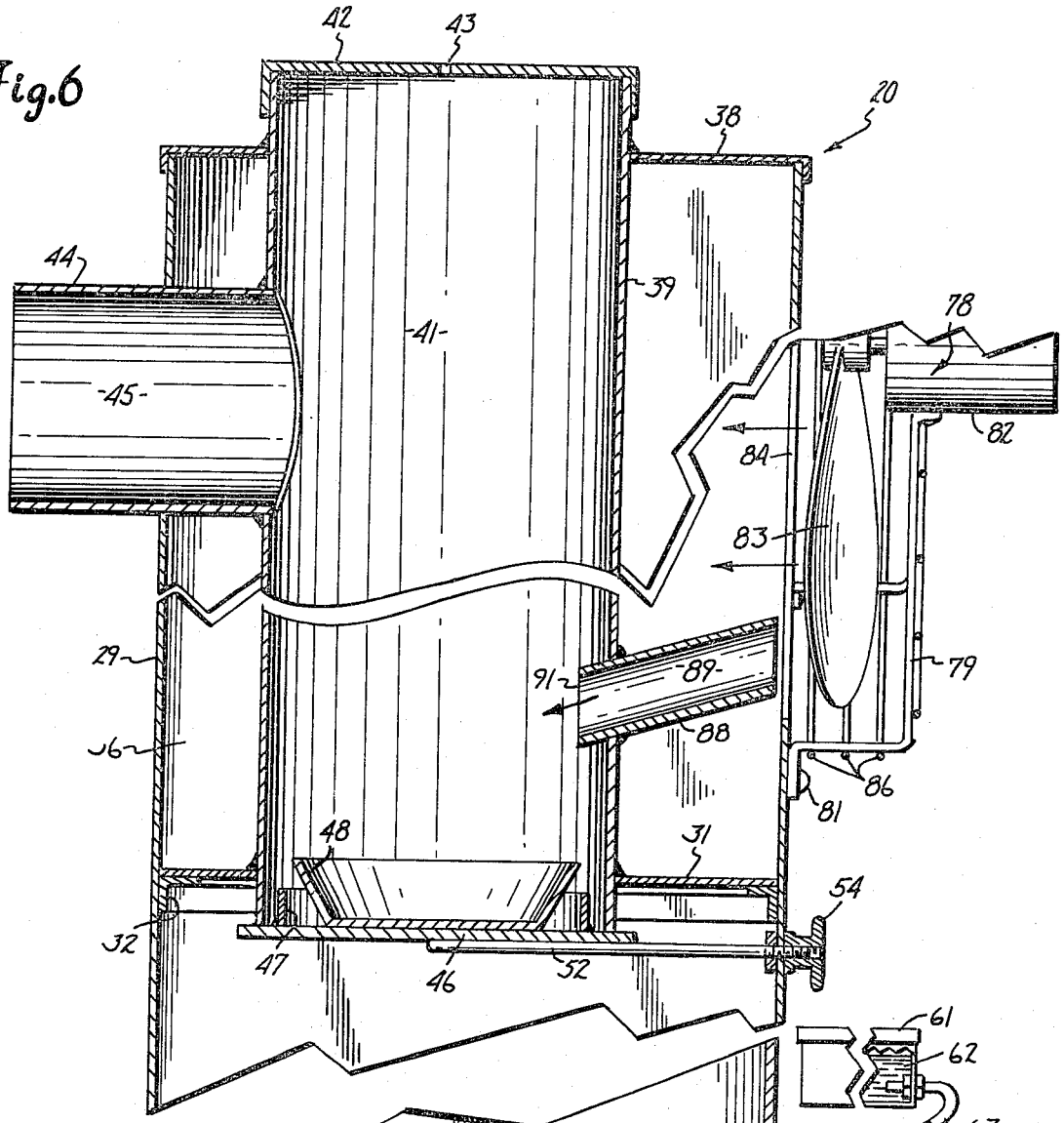
FIG. 6 is an enlarged foreshortened sectional view taken along the line 6—6 of FIG. 4.

As shown in FIGS. 4 and 5, an upright cylindrical casing or tube 39 extends through holes in bottom wall 31 and top wall 38 and is secured thereto by welds or the like. Casing 39 is a cylindrical metal member which functions to provide the rapid transfer of heat to the heating chamber. Casing 39 has an upright cylindrical combustion chamber 41. A cover 42 rests on top of casing 39 to close the upper end of combustion chamber 41. Cover 42 is a heavy cylindrical metal cap having a circular flange that fits over the upper end of casing 39. Cover 42 has a small central hole 43 providing a sight or visual observation opening into combustion chamber 41. Cover 42 is removable from casing 39 to provide access to combustion chamber 41 for starting the burning of the fuel in the combustion chamber and cleaning the combustion chamber. A lateral exhaust pipe or tube 44 is secured to the upper end of casing 39. As shown in FIG. 6, tube 44 has a passage 45 leading from combustion chamber 41 to exhaust gas pipe 23.

The bottom of combustion chamber 41 is cosed with a bottom plate 46 having an upwardly directed circular ring 47. A combustion or fire pan 48 rests on plate 46. Pan 48 has an upwardly directed side wall which retains the fuel and flame 49 in the bottom of the combustion chamber 41.

A pair of rods 51 and 52 hold plate 46 in engagement with the bottom of tube 39. Rod 52 extends across the bottom of plate 46 and is threaded into a mount 54 mounted on wall 26. The opposite end of rod 52 extends through a hole in wall 29. Rods 51 and 52 have eyes 56 and 57 that facilitate the removal of the rods from the mounts 53 and 54. Rod 51 is connected to side wall 26 with a mount 53. The lower portion of side wall 26 has a rectangular removable door 58 providing access to lower chamber 37. Door 58 is of a size to permit convenient removal of plate 46 and fire pan 48 from casing 39. Door 58 can be a removable panel mounted on side wall 27.

Figure 7:
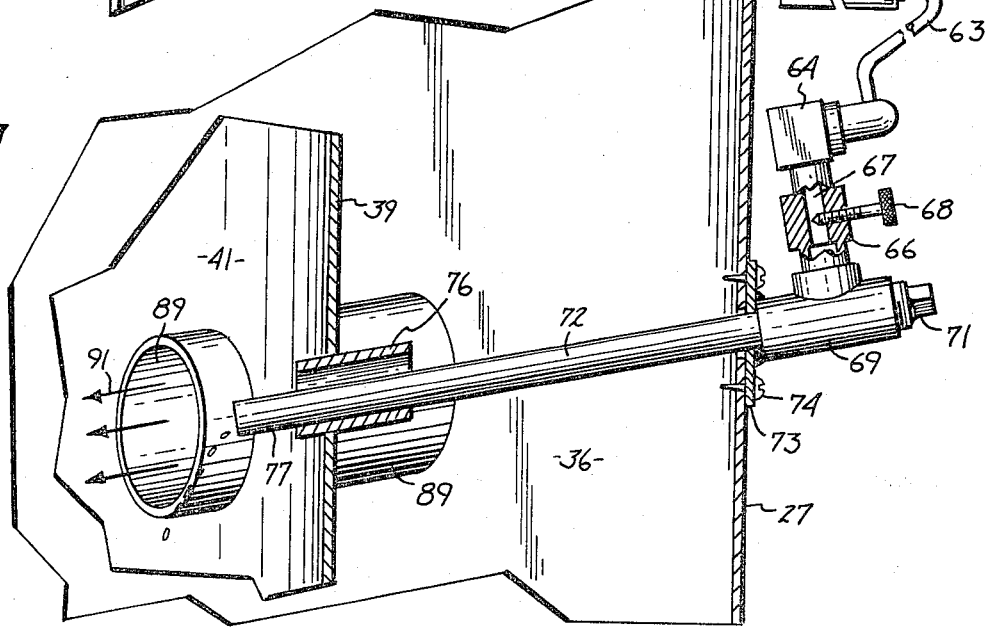
FIG. 7 is an enlarged sectional view taken along the line 7—7 of FIG. 4.

Referring to FIG. 7, there is shown a fuel supply apparatus indicated generally at 59 for delivering a controlled amount of liquid fuel, such as drain oil, fuel oil, kerosene, or the like, to combustion chamber 41. Fuel supply apparatus 59 is adjustable to use different types of liquid petroleum fuels. These fuels include crankcase drain oil, hydraulic fluids, drain oil from farm and industrial machinery, aviation fluids, transmission fluids, as well as the conventional number 1 and number 2 fuel oils.

Fuel apparatus 59 has a remote located reservoir or tank 61 for storing the liquid fuel, such as drain oil. Tank 61 is spaced from heating apparatus 20 and is located at an elevation so that the liquid fuel flows by gravity to combustion chamber 41. An elongated line or hose 63 carries the fuel from tank 61 to an automatically operated on-off valve 64. Valve 64 is a solenoid operated valve that is operated in response to the electric signals from a high temperature and low temperature control 96 hereinafter described.

Valve 64 is mounted on a flow control housing 66 having a passage 67 for carrying fuel from valve 64 to a T-coupling 69. The rate of flow of fuel through passage 67 is controlled with an adjustable needle valve 68.

The outer end of T-coupling 69 extends through chamber 36 and a sleeve 76 mounted on casing 39. A mounting plate 73 secured to T-coupling 69 is attached to side wall 27 with a plurality of screws 74 to thereby mount the fuel supply apparatus 59 on side wall 27. Pipe 72 has an inner or discharge end 77 that extends through sleeve 76 and into combustion chamber 41 above fire pan 48. Pipe 72 is inclined downwardly and forwardly so that the liquid fuel will flow down through the passage in pipe 72 and be discharged from the pipe end 77 into the combustion chamber above fire pan 48.

Figure 2:
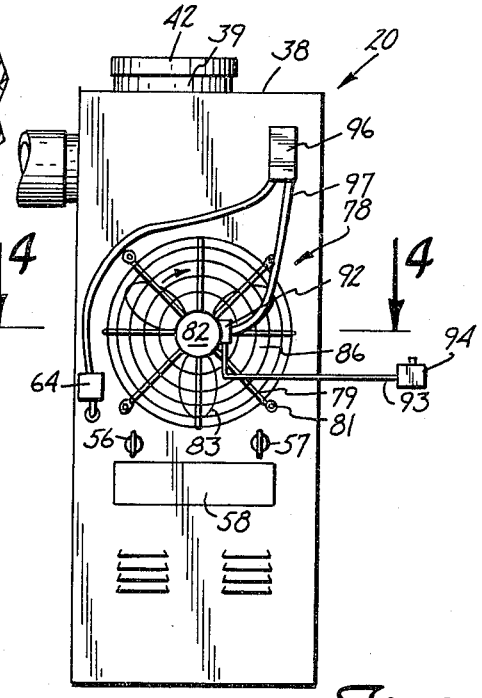
FIG. 2 is a side elevational view of the left side of FIG. 1.
Figure 3:
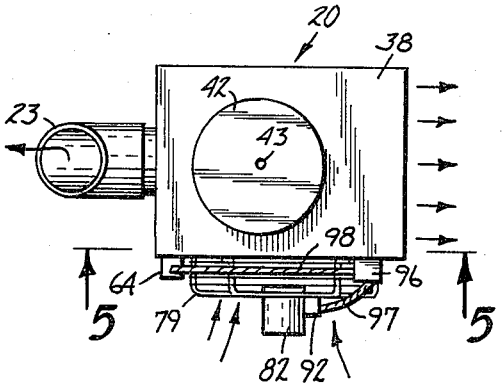
FIG. 3 is a top plan view of the heating apparatus of FIG. 1.

Referring to FIGS. 2, 4, and 6, an air supply apparatus indicated generally at 78 is operable to concurrently supply air to combustion chamber 41 and the heat transfer chamber 36. The air moves around cylindrical casing 39 and flows through the discharge opening of housing side wall 28. The discharge opening is covered with an expanded metal member or screen 30 having a plurality of openings which allow air to flow to the environment surrounding the heating apparatus. The air supply apparatus 78 has a rod support frame 79 attached to the outside of side wall 26 with a plurality of bolts 81. An electric motor 82 is mounted on the center of frame 79. Motor 82 has a drive shaft carrying a fan 83. The fan 83 has a plurality of blades which are inclined in the curved shape of propeller blades, so that on rotation of fan 83 by motor 82 air is moved through inlet opening 84 in side wall 26. Opening 84, as shown in FIG. 6, is axially aligned with the fan 83 so that the fan will move outside air into the heat transfer chamber 36. A plurality of circular guard rods 86 secured to frame 79 shield the rotating fan 83 from external objects.

As shown in FIGS. 4 and 5, an upright baffle or partition 87 extends from the right side of side wall 26 to cylindrical casing 39. Baffle 87 separates inlet opening 84 from the exit opening accommodating screen 30. The air moved by fan 83 is deflected by partition 87 in a counter-clockwise direction, as shown by arrows in FIG. 4, around the outside of casing 39. The air flowing through chamber 36 picks up the heat from the outside cylindrical surface of casing 39. Heat is also radiated from casing 39. The speed of motor 82 can be varied to control the rate of flow of air through heating chamber 36.

As shown in FIGS. 4 and 6, a downwardly and inwardlyinclined tubular member 88 having a passage 89 is secured to casing 39. Tubular member 88 faces fan 83 whereby the fan 83 moves air through passage 89 into combustion chamber 41, as indicated by arrow 91. The air is introduced into combustion chamber 41 as a continuous stream to provide for forced air combustion of fuel. As shown in FIG. 4, tubular member 88 is off-center from the center of the combustion chamber 41 so that air 91 is moved in a clockwise circular direction in combustion chamber 41. The longitudinal axis of passage 89 is along a cord line of combustion chamber 41 so as to provide the air with a circular motion in the circular combustion chamber. The air in combustion chamber 41 is forced into engagement with the inside wall of casing 33. The air is discharged from tubular member 88 in front of the end 77 of fuel discharge pipe 72 so that sme of the liquid fuel is picked up by the air and moved around the combustion chamber 41. The introduction of air into flame 49 and the mixing of the air with the fuel provides for an efficient and substantially complete combustion of the fuel. The complete combustion of the fuel insures a minimum emission of pollutants into the atmosphere. The fuel is burned in a cylindrical pattern adjacent the inside of the casing. This provides for a maximum heat transfer of heat from the burning fuel and hot gases to the casing 39.

Motor 83, as shown in FIG. 2, carries a power control unit 92 operable to control the electrical power to motor 82. Control unit 92 is connected with a line 93 to a power supply, as conventional 110 Voltage A.C. electric power.

An on-off switch 94 is located in line 93 for manually controlling the operation of motor 82. Control unit 92 is connected to a thermostatically controlled switch or control 96 with a line 97. Switch 96 operates to run motor 82 on when the temperature in the chamber 36 falls below a selected level. Thermostatically controlled switch 96 is connected with a line 98 to solenoid 64. Switch 96 will continue to supply power to solenoid 64 to energize the solenoid, as long as the temperature is within a selected range. If the temperature falls below a low level, the switch 96 will de-energize solenoid 64, thereby closing the valve and terminating the supply of oil to the pipe 72. If the temperature in chamber 36 exceeds a selected maximum level, the thermostatically controlled switch 96 will de-energize solenoid 64 to terminate the supply of oil to the discharge pipe 72. This prevents over-heating of heating apparatus 20.

In use, referring to FIG. 6, the fire pan 48 is located on the plate 46 in the bottom of the combustion chamber 41. The rods 51 and 52 hold the plate 46 in engagement with the lower end of casing 39. The cover 42 is removed from the top of the casing. Combustible materials, such as paper, is placed in the fire chamber 41 adjacent fire pan 48. The solenoid operated valve 64 is energized to permit the flow of liquid fuel through the pipe 72 into the combustion chamber. The combustible material in the combustion chamber 41 is ignited with a match or other lighting device. The cover 42 is then placed on top of casing 39.

The switch 94 is turned on so that the power is supplied to the fan motor 82 and the thermostat control 96. The motor 82 drives the fan 83, thereby moving air through the passage 89 of the tubular member 88. The air, indicated by arrow 91, is supplied to the combustion chamber 41 to facilitate the combustion of the fuel and combustible material in the chamber. As shown in FIG. 4, the air flowing through tubular member 88 is introduced into the combustion chamber offset from the diameter line of the chamber so that the air is forced in a circular direction around the inside wall of the casing 39. The outlet end of a fuel supply pipe 72 is located in combustion chamber 41 adjacent the outlet end of the tubular member 88. As shown in FIG. 7, the outlet end 77 of pipe 72 and the outlet end of tubular member 88 are located in substantially the same horizontal plane. The fuel discharged from the outlet end 77 is mixed with the air being forced into the combustion chamber. The thorough mixing of the air and fuel facilitates the substantially complete combustion of the fuel, thereby providing a maximum heat energy output during the combustion process of the fuel. The air introduced into the combustion chamber is heated in the combustion process. The heated air and burning fuel moves in a circular direction adjacent the inside wall of casing 39 and flows upwardly to the exit passage 45 and out through the exhaust pipe 23.

Fan 83 moves a substantial supply of air through the inlet opening 84 into the heating passage 36. As shown in FIG. 4, the partition 87 prevents the air from flowing directly from inlet opening 84 through the exit screen 30. Partition 87 acts as a barrier which directs the air into engagement with the hot casing 39. The air moves around the casing 39 to the exit opening of the housing. The air in the heating chamber 36 picks up the heat from the hot casing 39. The air is also heated by the heat radiated from the casing 39. In use, with waste oil as the fuel, the air is heated in the range of 150 degrees to 200 degrees Fahrenheit.

Control unit 96 is a thermostatically controlled switching device that is operable in response to the temperature of the air in the heating chamber 36 to control the operation of the fan motor 82 and the solenoid operated valve 64. When the temperature of the air in chamber 36 exceeds a preselected level, the control device 96 will terminate the supply of power to motor 82 and de-energize the valve 64, thereby stopping the forced flow of air into the combustion chamber and the heating chamber and terminating the supply of fuel to the combustion chamber. In the event that the flame goes out in the combustion chamber, the temperature of the air in the heating chamber will drop below a preselected level. The control device 96 will terminate the supply of power to the electric motor 82 and de-energize the solenoid. This will automatically shut off the heating apparatus 20. The apparatus must be manually turned on and ignited, as previously described.

Figure 8:
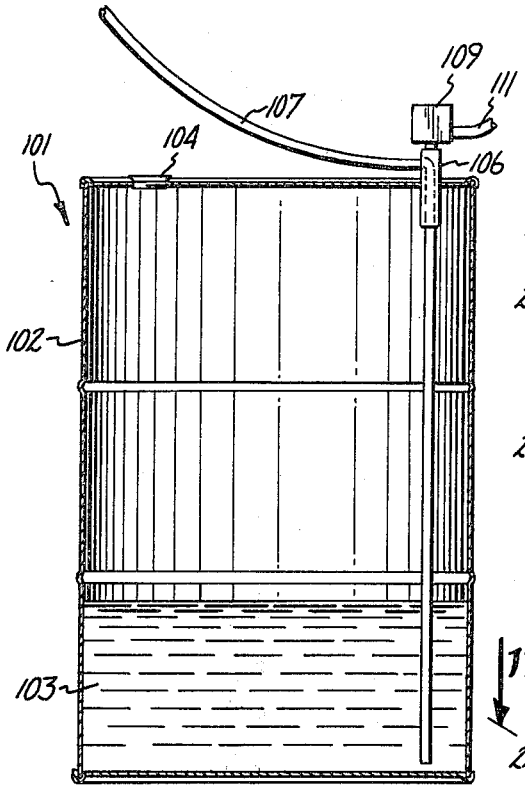
FIG. 8 is a side elevational view partly sectioned of an alternative fuel reservoir useable with the heating apparatus of FIG. 1.
Figure 9:
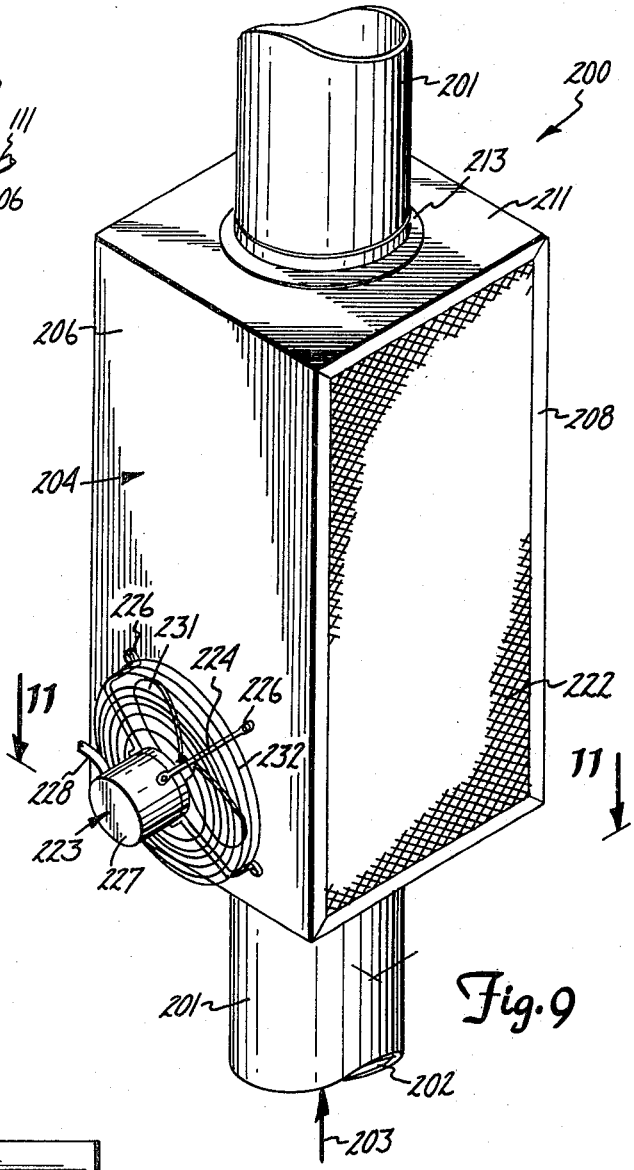
FIG. 9 is a perspective view of a modification of the heating apparatus of the invention.
Figure 10:
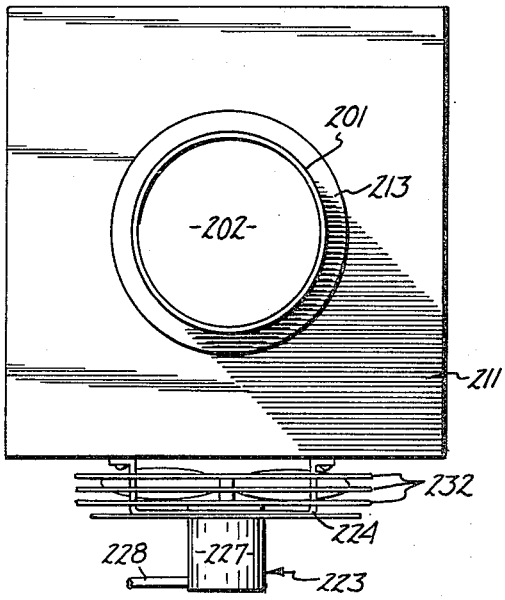
FIG. 10 is a top plan view of FIG. 9.

Referring to FIG. 8, there is shown an alternate fuel reservoir and supply apparatus indicated generally at 101 for supplying the liquid fuel, such as drain oil, to the solenoid valve 64. The apparatus 101 comprises a drum 102, such as a conventional 55 gallon drum supported on the floor remote from the heating apparatus. The drum 102 stores liquid fuel 103, such as drain oil. The top of the drum 102 has a removable cap 104 to allow the drain oil to be poured into drum 102.

A tubular member 106 is mounted on the top wall of drum 102. A hose 107 connected to tubular member 106 leads to solenoid valve 64. A downwardly directed pipe 108 extended up into tubular member 106 is connected to a coupling leading to hose 107. Pipe 108 has a lower end located close to the bottom of drum 102 so that liquid 103 will be forced up the pipe 108 and into hose 107. An air pressure regulator 109 is mounted on top of tubular member 106. Air under pressure is supplied to regulator 109 through an air line 111. Regulator 109 is operable to maintain the air pressure between the range 2 to 4 psi in drum 102. The air pressure in drum 102 is sufficient to provide a continuous supply of liquid fuel to solenoid 104.

Referring to FIGS. 9–12, there is shown a modification of the heating apparatus of the invention indicated generally at 200 for heating the air in a room or similar space. The heating apparatus 200 is used with a tubular casing or pipe 201 having a passage 202 for carrying hot fluid, as air, gases, and liquid. The casing can be a tubular pipe for carrying hot air from a clothes dryer, furnace, or other source of hot air. Heating apparatus 200 can be mounted on a portion of the pipe 23. The heating apparatus 200 is shown in FIG. 1.

Apparatus 200 has a generally box-shaped housing 204 that surrounds a portion of casing 201. Housing 204 has four generally rectangular side walls 206, 207, 208, and 209 joined to a square top wall 211. Top wall 211 has a central circular opening 212 accommodating casing 201. A ring 213 surrounds casing 201 and is secured to top wall 211 to support housing 204 on casing 201. The bottom of the housing 204 is closed with a bottom wall 214 having an opening 216 accommodating casing 201. A ring 217 surrounds casing 201 and is secured to bottom wall 214. Housing 204 has an internal heating chamber 218 surrounding a portion of casing 201 located between the top and bottom walls 211 and 214, respectively .

Figure 11:
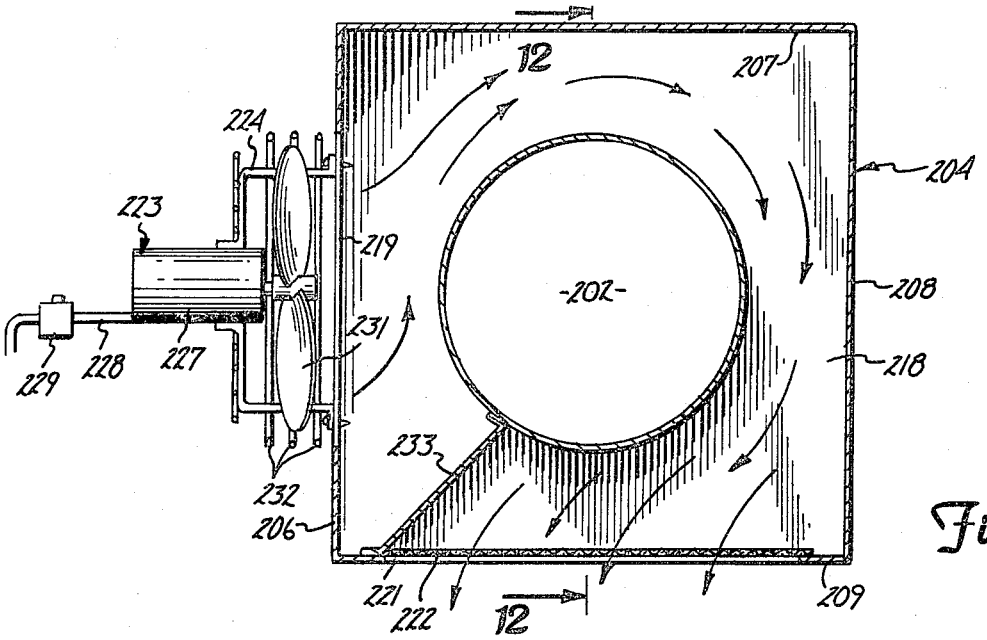
FIG. 11 is an enlarged sectional view taken along the line 11—11 of FIG. 9.
Figure 12:
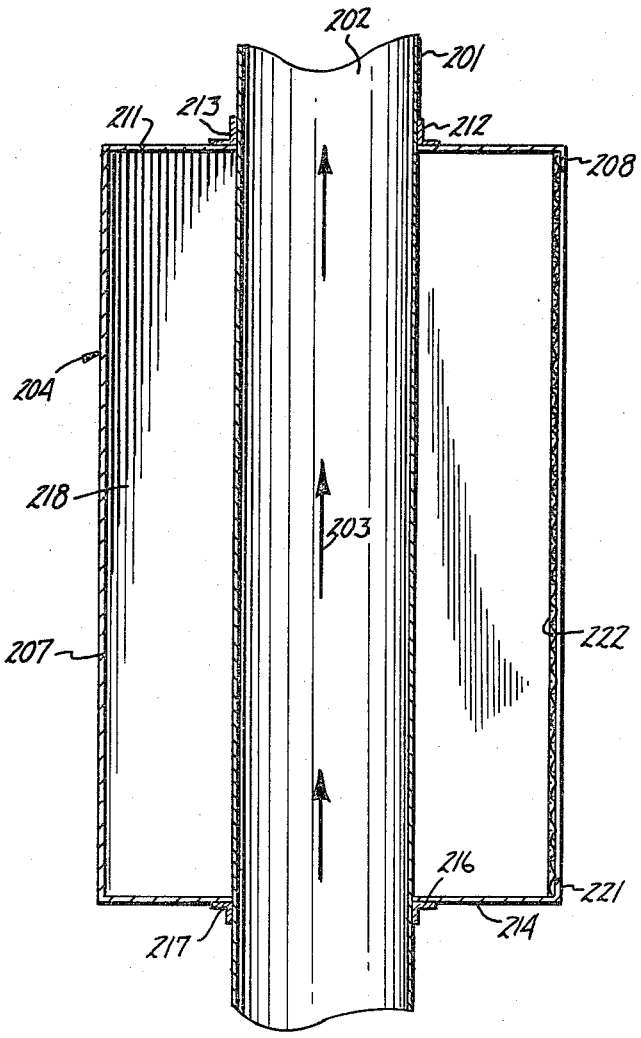
FIG. 12 is a sectional view taken along the line 12—12 of FIG. 11.

As shown in FIG. 11, side wall 206 has a circular inlet opening 219 adjacent the lower section thereof. Side wall 209 has a rectangular outlet opening 221. A screen or expanded metal member 222 located over opening 221 is mounted on side wall 208.

An air supply apparatus indicated generally at 223 is mounted on side wall 206 adjacent the outside of inlet opening 219. The air supply apparatus 223 functions to move air externally of housing 204 into heating chamber 218. As shown by the arrows in FIG. 11, the air moves around the casing 201 and is discharged through the screen 222 into the environment adjacent housing 204. The air supply apparatus has a rod frame 224 secured to side all 206 with bolts 226. An electric motor 227 is mounted on the center of frame 224. The motor 227 is connected to a power supply with a cord or line 228. An on-off switch 229 in line 228 functions to control the power supplied to motor 227. On-off switch 229 can have suitable controls to which are used to vary the speed of the motor 227. The motor 227 has a conventional drive shaft which supports a fan 231. The fan 231 has a plurality of outwardly directed blades. Fan 231 serves as a propeller to move air through the inlet opening 219 into heating chamber 218. A plurality of spaced circular guard rods 232 mounted on frame 224 form a protection shield for the moving fan 231.

As shown in FIG. 11, an upright baffle or partition 233 extends between the left corner of side wall 209 and the casing 201. The partition 233 extends from the top to the bottom walls 211 and 214 and serves as a barrier or blocking wall between the inlet opening 219 and the outlet opening 221. The partition 233 directs the air in a clockwise direction around casing 201, as shown by the arrows in FIG. 11.

In use, the air supply apparatus 231 functions to continuously move air through the inlet opening 219 and into the heating chamber 218. The heat from the hot air or gases in the passage 201 is transmitted to the metal material of the casing 201. This heat is transferred from the casing and picked up by the air as it moves around heating chamber 218. The heated air is discharged through the outlet opening 221 into the atmosphere surrounding housing 204.

While there has been shown and described the preferred embodiments of the heating apparatus of the invention, it is understood that changes in the parts and arrangement of parts and materials can be made by those skilled in the art without departing from the invention. The invention is defined in the following claims.

The embodiments of the invention in which an exclusive property or privilege is claimed are defined as follows:

1. An apparatus for heating fluid comprising: a housing having a fluid heating chamber, a fluid inlet opening and a fluid exit opening open to said chamber, a casing having a combustion chamber, exhaust means connected to the casing for carrying gas from the combustion chamber, means locating the casing in the fluid heating chamber, means for supplying fuel to said combustion chamber, said fuel, when burned, heating the casing, fluid moving means mounted on the housing for moving fluid through the fluid inlet opening, the fluid heating chamber, and the fluid exit opening, said fluid in the heating chamber being heated by the casing, partition means in said fluid heating chamber secured to the casing and housing, said partition means comprising solid wall means extending between the casing and housing for directing fluid moved by the fluid moving means around the casing, and means having a passage for directing fluid from the fluid moving means into the combustion chamber.

2. The apparatus of claim 1 wherein: the housing has a first side wall having said gas inlet opening, and a second side wall having said fluid exit opening, said first and second side walls being located adjacent each other, said partition means extended from one of said first and second side walls to said casing.

3. The apparatus of claim 2 wherein: said first and second side walls are normally disposed with respect to each other, said first and second side walls having adjacent edges forming a corner of said housing, said solid wall means of said partition means extended from said corner to said casing.

4. The apparatus of claim 1 wherein: said housing includes a bottom wall, said casing being secured to said bottom wall and having a bottom opening below said bottom wall, means for closing said bottom opening, said means for closing said bottom opening being removable from said casing to facilitate cleaning of the combustion chamber.

5. The apparatus of claim 4 wherein: the means for closing said bottom opening comprises a plate extended across said opening, and removable means for holding the plate in engagement with the casing to close the opening.

6. The apparatus of claim 5 including: pan means supported by the plate in the combustion chamber.

7. The apparatus of claim 5 wherein: the removable means includes a plurality of rod means mounted on the housing.

8. The apparatus of claim 1 wherein: the means having a passage for directing fluid from the fluid moving means into the combustion chamber is a tubular member secured to the casing and extended from the casing to the fluid inlet opening.

9. The apparatus of claim 8 wherein: the passage has a longitudinal axis that is offset from the center of the combustion chamber.

10. The apparatus of claim 9 wherein: the tubular member is inclined downwardly toward the casing.

11. The apparatus of claim 1 wherein: the casing has an opening in the upper end thereof, and a cover for closing the opening in the upper end of the casing.

12. The apparatus of claim 1 wherein: the means for supplying fuel to said combustion chamber includes tubular means for carrying fuel across the heating chamber and discharging fuel into the combustion chamber, and valve means for controlling the amount of fuel discharged into the combustion chamber.

13. The apparatus of claim 12 wherein: the valve means includes an on-off valve and a valve for adjusting the rate of movement of fuel to the tubular means.

14. The apparatus of claim 1 wherein: the means for supplying fuel to said combustion chamber includes means for discharging said fuel into the combustion chamber adjacent the exit end of said passage for directing gas from the fluid moving means into the combustion chamber.

15. The apparatus of claim 1 wherein: said fluid moving means comprises a frame mounted on the housing, a motor mounted on the frame, and fan means drivably connected to the motor operable by said motor to move gas through the inlet opening into the heating chamber and passage into the combustion chamber.

16. The apparatus of claim 15 including: control means operable to terminate the power supply to said motor when the temperature of the fluid in the fluid heating chamber exceeds a preselected upper temperature or falls below a preselected lower temperature.

17. The apparatus of claim 1 wherein: the means for supplying fuel to said combustion chamber includes a solenoid operated on-off valve, the fluid moving means includes a motor and means for moving fluid drivably connected to said motor, and control means operable to terminate the power supply to said solenoid and motor when the temperature of the fluid in the fluid heating chamber exceeds a preselected upper temperature or falls below a preselected lower temperature.

18. The apparatus of claim 1 including: a sleeve secured to the casing, said sleeve having a passage open to the combustion chamber, said means for supplying fuel to said combustion chamber including tubular means extended through said passage in the sleeve.

19. The apparatus of claim 1 wherein: the heating chamber has a longitudinal axis, said casing located in said heating chamber generally parallel to said longitudinal axis.

20. The apparatus of claim 1 wherein: the casing is an elongated cylindrical member.

21. The apparatus of claim 20 wherein: the partition means is an upright wall engageable with the casing and housing.

22. An apparatus for heating fluid comprising: a housing having a fluid heating chamber, a fluid inlet opening, and a fluid exit opening open to said chamber, casing means having a combustion chamber, said casing means being located in said heating chamber, exhaust means connected to the casing means for carrying gas from the combustion chamber, means for supplying fuel to said combustion chamber, said fuel, when burned, heating the casing, fluid moving means mounted on the housing for moving fluid through the fluid inlet opening, the fluid heating chamber, and the fluid exit opening, said fluid in the heating chamber being heated by the casing means, solid wall means in said fluid heating chamber extended between the case and housing providing a one-way passage for directing fluid around the casing means, and means having a passage for directing fluid from the fluid moving means into the combustion chamber to promote burning of fuel in the combustion chamber.

23. The apparatus of claim 22 wherein: said housing includes a bottom wall, said casing being secured to said bottom wall and having a bottom opening below said bottom wall, means for closing said bottom opening, said means for closing said bottom opening being removable from said casing to facilitate cleaning of the combustion chamber.

24. The apparatus of claim 23 wherein: the means for closing said bottom opening comprises a plate extended across said opening, and removable means for holding the plate in engagement with the casing to close the opening.

25. The apparatus of claim 24 including: pan means supported by the plate in the combustion chamber.

26. The apparatus of claim 24 wherein: the removable means includes a plurality of rod means mounted on the housing.

27. The apparatus of claim 22 wherein: the means having a passage for directing fluid from the fluid moving means into the combustion chamber is a tubular member secured to the casing and extended from the casing to the fluid inlet opening.

28. The apparatus of claim 27 wherein: the passage has a longitudinal axis that is ofset from the center of the combustion chamber.

29. The apparatus of claim 28 wherein: the tubular member is inclined downwardly toward the casing.

30. The apparatus of claim 22 wherein: the casing has an opening in the upper end thereof, and a cover for closing the opening in the upper end of the casing.

31. The apparatus of claim 22 wherein: the means for supplying fuel to said combustion chamber includes tubular means for carrying fuel across the heating chamber and discharging fuel into the combustion chamber, and valve means for controlling the amount of fuel discharged into the combustion chamber.

32. The apparatus of claim 31 wherein: the valve means includes an on-off valve and a valve for adjusting the rate of movement of fuel to the tubular means.

33. The apparatus of claim 22 wherein: the means for supplying fuel to said combustion chamber includes means for discharging said fuel into the combustion chamber adjacent the exit end of said passage for directing gas from the fluid moving means into the combustion chamber.

34. The apparatus of claim 22 wherein: said fluid moving means comprises a frame mounted on the housing, a motor mounted on the frame, and fan means drivably connected to the motor operable by said motor to move gas through the inlet opening into the heating chamber and passage into the combustion chamber.

35. The apparatus of claim 34 including: control means operable to terminate the power supply to said motor when the temperature of the fluid in the fluid heating chamber exceeds a preselected upper temperature or falls below a preselected lower temperature.

36. The apparatus of claim 22 wherein: the means for supplying fuel to said combustion chamber includes a solenoid operated on-off valve, the fluid moving means includes a motor and means for moving fluid drivably connected to said motor, and control means operable to terminate the power supply to said solenoid and motor when the temperature of the fluid in the fluid heating chamber exceeds a preselected upper temperature or falls below a preselected lower temperature.

37. The apparatus of claim 22 including: a sleeve secured to the casing, said sleeve having a passage open to the combustion chamber, said means for supplying fuel to said combustion chamber including tubular means extended through said passage in the sleeve.

38. The apparatus of claim 22 wherein: the heating chamber has a longitudinal axis, said casing located in said heating chamber generally parallel to said longitudinal axis.

39. The apparatus of claim 22 wherein: the casing is an elongated cylindrical member.

40. The apparatus of claim 22 wherein: said solid wall means is an upright wall.

41. The apparatus of claim 40 wherein: said housing has a top wall and bottom wall, said upright wall extended between said top and bottom walls.

* * * * *